US005368757A

United States Patent [19]

King

[11] Patent Number: 5,368,757

[45] Date of Patent: Nov. 29, 1994

[54] LUBRICATION FOR COLD FORMING OF METALS

[75] Inventor: Peter F. King, Farmington Hills, Mich.

[73] Assignee: Henkel Corporation, Plymouth Meeting, Pa.

[21] Appl. No.: 5,913

[22] Filed: Jan. 19, 1993

Related U.S. Application Data

[63] Continuation of Ser. No. 771,089, Oct. 2, 1991, abandoned, which is a continuation-in-part of Ser. No. 673,874, Mar. 22, 1991, abandoned.

[51] Int. Cl.[5] ..... C10M 107/22; C10M 107/34; C10M 145/02; C10M 145/38

[52] U.S. Cl. ..... 252/34; 252/34.7; 252/32.5; 252/41; 252/49.3; 252/49.5; 252/56 D; 252/52 A; 72/42

[58] Field of Search ..... 252/41, 49.3, 49.5, 252/56 D, 34, 34.7, 52 A, 32.5; 72/42

[56] References Cited

U.S. PATENT DOCUMENTS

| | | | |
|---|---|---|---|
| 3,527,726 | 9/1970 | Gower | 252/49.8 |
| 3,568,486 | 3/1971 | Rosenberg et al. | 72/42 |
| 3,629,112 | 12/1971 | Gower | 252/49.3 |
| 3,645,897 | 2/1972 | Gower | 252/44.7 |
| 3,657,123 | 4/1972 | Stram | 252/49.3 |
| 4,285,223 | 8/1981 | Das et al. | 72/42 |
| 4,403,490 | 9/1983 | Sargent | 252/49.5 |
| 4,416,132 | 11/1983 | Sargent | 252/49.5 |
| 4,636,321 | 1/1987 | Kipp et al. | 252/32.5 |
| 4,654,155 | 3/1987 | Kipp et al. | 252/32.5 |
| 4,731,190 | 3/1988 | O'Lenick et al. | 252/49.3 |
| 4,931,197 | 6/1990 | Beck et al. | 252/56 R |

FOREIGN PATENT DOCUMENTS

| | | |
|---|---|---|
| 0267558 | 5/1988 | European Pat. Off. . |
| 52-065748 | 5/1977 | Japan . |
| 59-149995 | 8/1984 | Japan . |
| 60-099200 | 6/1985 | Japan . |
| 63-008489 | 1/1988 | Japan . |
| 63-301297 | 12/1988 | Japan . |
| 433201 | 12/1974 | U.S.S.R. . |

OTHER PUBLICATIONS

Bastian, *Metalworking Lubricants*, McGraw-Hill, NY, p. 65, (1951).

R&D Magazine, Oct. 1991, p. 75.

"Improving Nonferrous Wire Quality Through Proper Lubricant Selection and Maintenance" by Ike Tripp, Mar. 1991.

*Primary Examiner*—Prince Willis, Jr.
*Assistant Examiner*—Alan D. Diamond
*Attorney, Agent, or Firm*—Ernest G. Szoke; Wayne C. Jaeschke; Norvell E. Wisdom, Jr.

[57] ABSTRACT

An effective lubricant for cold working of metals is provided by a combination of a water soluble copolymer of styrene with maleic anhydride, maleic acid, and/or an ammonium or substituted ammonium maleate salt with an ethoxylated alcohol, preferably an alcohol with at least 40 carbon atoms before ethoxylation and about 50% of its mass in the polyoxyethylene block in the molecule.

20 Claims, No Drawings

LUBRICATION FOR COLD FORMING OF METALS

CROSS-REFERENCE TO RELATED APPLICATION

This application is a continuation of copending application Ser. No. 07/771,089 filed Oct. 2, 1991, now abandoned, which is a continuation-in-part of application Ser. No. 07/673,874 filed Mar. 22, 1991, now abandoned.

BACKGROUND OF THE INVENTION

1. Field of the Invention

This invention relates to concentrate compositions suitable for dilution with water to produce aqueous based compositions that are useful for lubricating the surfaces of metals, especially steel, before and during cold forming operations, particularly cold drawing operations. The metal surfaces may or may not have other surface layers such as phosphate conversion coatings, anodized coatings, or the like underlying the lubricant coating produced on the surface by using this invention. The invention also relates to the lubricating compositions ready for immediate use and to cold working processes utilizing such compositions.

2. Statement of Related Art

A very wide variety of materials have been taught in the art for lubricating metals before cold working. The composition believed to be most commonly used now commercially combines alkali metal and alkaline earth metal soaps, particularly stearates including zinc stearate. These soap containing compositions of the prior art give excellent lubricating performance, but generate dusts which can annoying to users with less than optimal ventilation systems. There has consequently been an incentive to find other lubricating compositions that will give lubricating performance at least as good as that of the prior art soap based compositions and generate less dust during use. Some teachings along this line believed to be those most nearly pertinent to the present invention are reviewed below.

Published Japanese Application No. 63-301297 according to an abstract thereof teaches an emulsion type metal rolling oil composition containing a lubricating oil component selected from animal and vegetable oils and fats, mineral oils, and fatty acid esters along with another component which may be a copolymer of styrene and maleic acid.

Published Japanese Application No. 63-008489 according to an abstract thereof teaches an aqueous lubricant for the cold forming of metal. The lubricant contains an acrylate based heat curing resin, wax, and surfactant. The resin is a polymer of at least four monomers, of which two may be styrene and maleic acid or its salts, the others being acrylates.

Published Japanese Application No. 60-099200 according to an abstract thereof teaches a two step process for preparing metals for cold forming. In the first step a mixture of water soluble thermoplastic resin and a melamine adduct of cyanuric or isocyanuric acid is applied to the metal surface and dried. The thermoplastic resin may be a copolymer of maleic acid and styrene. In a second step a conventional lubricating soap, oil, or solid lubricant is applied.

Published Japanese Application No. 59-149995 according to an abstract thereof teaches a lubricating composition for metal working comprising wax, fatty acid, amine or amine derivatives, an alkali soluble resin, and an extreme pressure additive. The wax may be a paraffin or polyolefin wax and the alkali soluble resin may be a styrene-maleic acid resin.

U.S. Pat. Nos. 4,403,490 and 4,416,132 according to abstracts thereof teach lubricant compositions for forming cans from untinned steel. One such composition comprises terpene-phenol resin, esterified styrene-maleic anhydride, synthetic polymethylene wax, unsaturated fatty acid, amines, potassium hydroxide, and solid lubricants.

Published Japanese Application No. 52-065748 according to an abstract thereof teaches metal lubricating oils made by adding a styrene copolymer, which may be a polymer with maleic anhydride acid or ester, to a conventional composition such as mineral oil or fat.

Published Soviet Patent application No. 433,201 according to an abstract thereof teaches a lubricant composition for cold working metals that comprises sodium soap, styrene-maleic anhydride copolymer, free fatty acid, water, and mineral oil.

U.S. Pat. Nos. 3,657,123, 3,645,897, 3,629,112, and 3,527,726 according to abstracts thereof all teach lubricating compositions containing amine salts of partial esters of styrene-maleic anhydride copolymers with alcohols, which may be alkoxylated alcohols.

Published European Patent Application No. 267,558 teaches metalworking lubricants containing a water soluble thermoplastic polymer, the polymer containing some hydrophobic groups, combined with an ethoxylated alcohol. Although the broadest teachings of this reference are to any water soluble polymer containing hydrophobic groups in which at least some of the segments include at least two hydrophobic groups, the only examples of the polymers taught are polyurethanes.

U.S. Pat. Nos. 4,731,190, 4,654,155, and 4,636,321 all teach various metal working lubricant compositions including alkoxylated alcohols.

U.S. Pat. No. 4,931,197 teaches as metal working lubricants aqueous emulsions of copolymers of (i) alpha-olefins and (ii) esters of unsaturated carboxylic acids with ethoxylated alcohols.

U.S. Pat. No. 3,568,486 of Mar. 9, 1971 to Rosenberg et al. teaches a general scheme of lubricating metal for cold working involving a "permanent" coating of a resinous lubricant which is temporarily softened by an overlay coating of liquid containing a plasticizer for resinous coating when greater lubricity is needed. The preferred resinous composition is alkali soluble acrylic and/or methacrylic acid polymer, mixed with a relatively minor amount of styrene-maleic acid copolymer. This may be softened when desired with mineral oil, lard, ethylene glycol, or the like.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the exact numerical limits stated is generally preferred.

SUMMARY OF THE INVENTION

It has now been found that excellent lubricating film ductility, good drawability, and low die residue, or similar benefits in types of cold working other than drawing, can be achieved with a lubricant layer comprising, or preferably consisting essentially of:

(A) copolymers of styrene with (i) maleic anhydride, (ii) maleic acid, (iii) salts of maleic acid with ammonia, alkali metal hydroxides, and amines, or (iv) mixtures of any two or more of these, said copolymers containing a sufficient number of salt groups to be soluble and/or dispersible in water; and (B) a component consisting of ethoxylated alcohol molecules; and, optionally, (C) water;

(D) an extreme pressure and corrosion resistant additive component as known per se in the art;

(E) a component of dispersed and/or dissolved solid lubricant as known per se in the art; and (F) a component selected from solid and liquid hydrocarbons.

It should be understood that this description does not preclude chemical interactions among the components listed, but instead describes the components of a composition according to the invention in the form in which they are generally used as ingredients to prepare such a composition. However, at least part of components (A) and (B) must be present in a chemical form other than esters formed by reaction with each other.

The embodiments of the invention include liquid compositions for applying to metal surfaces to provide lubrication as described; solid and/or liquid layers on metal surfaces being cold worked, which may be formed, in the case of solid layers, by drying the liquid compositions originally applied; processes for cold working metals using such compositions for lubrication, and concentrates for making suitable compositions for direct application to metal surfaces by diluting the concentrates with water.

The compositions according to the invention provide a very pliable and ductile lubricating film, thereby leading to superior cold forming processes.

DESCRIPTION OF PREFERRED EMBODIMENTS

Extreme pressure additives, optional item (D) above, are generally a preferred component in compositions according to the invention, while solid lubricants and hydrocarbons, optional items (E) and (F) above, generally are preferably omitted, although they may be useful in some applications. The presence of water is highly preferred in liquid compositions according to the invention that are suited for initial application to metal, but in general it is preferred to dry the applied lubricant sufficiently to make it at least semi-solid before beginning actual cold working according to the invention.

Concentrates according to the invention preferably contain from 20–70% by weight solids, or more preferably from 30–60% by weight of dissolved solids. Lubricant compositions according to the invention, suitable for direct application to metal surfaces to be lubricated, preferably contain from 3–20, more preferably from 5–15, still more preferably from 8–12%, by weight total dissolved solids.

For purposes of this description, the term "maleic moiety" is defined as a portion of a polymer chain that conforms to one of the following general chemical formulas:

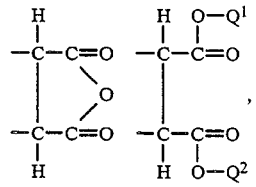

wherein each of $Q^1$ and $Q^2$, which may be the same or different, is selected from the group consisting of hydrogen, alkali metal, ammonium, and substituted ammonium cations. The copolymers of styrene and maleic moieties to be used in the invention preferably have a molar ratio of styrene to the maleic moieties in the range from 1:1 to 3:1, more preferably in the range from 1.5:1 to 2.6:1, still more preferably in the range from 1.8:1 to 2.3:1. Independently, the copolymers of styrene and maleic moieties to be used in the invention preferably are selected from polymers that have an average molecular weight in the range from 1100 to 2700, more preferably in the range from 1600 to 1950, still more preferably in the range from 1650 to 1750. Preferably these copolymers of styrene and maleic moieties to be used in the invention contain no more than 25, or with increasing preference no more than 12, 5, 3, or 0.5% by weight of units derived from other monomers.

The working compositions according to the invention are often used at fairly high temperatures such as 70° C. or more. At such temperatures, if the compositions contain unsubstituted ammonium cations, or other ammonium cations derived from high volatility amines, there is a substantial concentration of ammonia or free amine in the vapor space over the liquid working composition at equilibrium. Such concentrations can be objectionable to workers using the process.

In an industrial application, ammonia and/or amine concentrations are conventionally measured by a Drager test apparatus, which gives readings in $NH_3$ equivalents, with amines as well as with ammonia itself. It is preferred that the cations other than hydrogen used in a composition according to the invention be chosen from ammonium ions of amines having sufficiently low volatility that the equilibrium overpressure of $NH_3$ equivalents as measured by a Drager test apparatus in the atmosphere over compositions according to the invention at a temperature of 70° is, with increasing preference in the order given, not more than 50, 35, 25, 14, 9, 6, or 4 parts per million (hereinafter "ppm") of ammonia equivalent.

Independently, it is preferred, with increasing preference in the order given, that at least 50, 78, or 91 mole percent of the cations other than hydrogen present in component (A) as described above be selected from the group consisting of substituted ammonium cations derived by adding a proton to amines that will dissolve to form at least 0.01 M solutions, with a pH value of at least 10, in water. More preferably, the amines contain at least one hydroxyl group per molecule. Still more preferably, the substituted ammonium cations are selected from the cations formed by adding a proton to diethylethanol amine, diethanol amine, monoethanol amine, or iso-propanol amine.

It is also preferred that the pH of the liquid compositions for direct application to metal surfaces (also denoted as "working compositions" herein) fall within the range from 6 to 11, or more preferably in the range from 7.5 to 9.0. If needed, alkaline materials, preferably ammonium, sodium, potassium, or lithium hydroxide, in addition to the amines noted above, may be added to the compositions in order to achieve a pH within these ranges.

Component (B) of the compositions according to the invention is preferably selected from alcohols having a chemical structure that can be produced by condensing ethylene oxide with primary, preferably straight chain, aliphatic alcohols having only one hydroxyl group and from 30 to 65, more preferably from 40 to 60, still more preferably from 48 to 52 carbon atoms per molecule. Independently, it is preferred that the molecules of component (B) contain from 20 to 80, more preferably from 40 to 62, still more preferably from 48–51 percent of their total weight in the portion of each molecule having the chemical structure $-(CH_2-CH_2-O)_n$, where n is a positive integer.

The ratio by weight of component (A) to component (B) in compositions according to the invention is preferably between 6:1 and 1:6, or, in order of increasing preference, between 4:1 to 1:4, 2.5:1 to 1:2.5, 1:1.6 to 1:2.5, or 1:1.9 to 1:2.1.

Component (D) of the compositions according to the invention is preferably selected from partial esters, or salts of partial esters, of phosphoric acid with alcohols having a molecular structure that contains both (i) a part having the structure $-(CH_2)_m-$, where m is an integer between 12 and 22 inclusive, more preferably between 16 and 22 inclusive and (ii) a part having the structure $-(CH_2-CH_2-O)_p$, where p is an integer having a sufficiently large value that the total alcohol is soluble in water to the extent of, with increasing preference, at least 0.1, 0.4, 0.9, 1.3, 1.8, and 3 percent by weight.

If component (D) is used, it is preferably present in a ratio by weight to the total of components (A) and (B) within the range from 1:10 to 1:200, or more preferably from 1:25 to 1:70, still more preferably from 1:40 to 1:55.

If component (F) is used, it preferably is selected from substantially unsaturated aliphatic hydrocarbon compounds, including oligomers of ethylene, propylene, or mixtures of ethylene and propylene, with a molecular weight in the range from 750–3000, more preferably in the range from 1000–2000.

The areal density of a composition according to this invention present in place on metal to be cold worked, after application from a liquid composition to the metal surface and air drying of liquid thus applied, is, in order of increasing preference, from 0.1 to 15, 1 to 8, or 2 to 6 grams per square meter of surface ("$g/m^2$")

For cold drawing of steel, a lubricant composition according to this invention can be satisfactorily used on clean bare steel without any intermediate coating. Normally, however, it is preferred that a lubricant composition according to this invention be used in combination with an underlying zinc phosphate conversion coating layer formed on the steel. The zinc phosphate conversion coating may be formed by methods known per se in the art. Any phosphate conversion coating used before application of a lubricant composition according to this invention preferably has an areal density (also often denoted as "add-on weight") of from 1 to 50, or with increasing preference, from 1 to 30, 1 to 20, or 2 to 15, $g/m^2$.

The practice of this invention may be further appreciated from the following non-limiting examples.

EXAMPLE 1

A concentrated composition according to the invention was prepared from the following ingredients, with amounts shown in parts by weight:

| | |
|---|---|
| UNITHOX TM 480 ethoxylated alcohol | 30 |
| SMA TM 2000 styrene-maleic anhydride copolymer | 15 |
| ANTARA TM LB-400 (an extreme pressure and corrosion resistant additive) | 1 |
| water (deionized) | 54 |

UNITHOX TM 480, commercially available from Petrolite Corp., Tulsa, Okla., described by its supplier as having a number average molecular weight of about 2125, an ethylene oxide content of about 80% by weight, a hydroxyl number in milligrams of KOH per gram as measured according to ASTM Method E222 of about 23, and a melting point of about 85° C. SMA TM 2000, commercially available from Atochem, Inc., Malvern, Pa., is described by its supplier as a copolymer of styrene and maleic anhydride in a ratio of 2:1, with an average molecular weight of about 1700, an Acid Number of about 350, a melting range of about 140°–160° C., and a viscosity of about 136 centipoises at 30° C. in a solution containing 20% by weight total non-volatile material in aqueous ammonia. ANTARA TM LB-400, commercially available from GAF Corp., New York, N.Y., is described by its supplier as a partial phosphate ester on a polyethyleneoxy non-ionic surfactant base, soluble in both aliphatic and aromatic solvents and self-emulsifying in water, with an Acid Number of from 140–150 and a maximum phosphorus content of about 4.7%.

EXAMPLE 2

A concentrated composition according to the invention was prepared from the following ingredients, with amounts shown in parts by weight:

| | |
|---|---|
| UNITHOX TM 750 ethoxylated alcohol | 30 |
| SMA TM 2000 styrene-maleic anhydride copolymer | 15 |
| ANTARA TM LB-400 | 1 |

29% aqueous ammonia to give a pH of 8.3 water (deionized) to give a total of 100 parts. UNITHOX TM 750, commercially available from Petrolite Corp., Tulsa, Okla., is described by its supplier as having a number average molecular weight of about 1400, an ethylene oxide content of about 50% by weight, a hydroxyl number in milligrams of KOH per gram as measured according to ASTM Method E222 of about 34, and a melting point of about 107° C. The other materials were the same as in Example 1.

EXAMPLE 3

A concentrated composition according to the invention was prepared from the following ingredients, with amounts shown in parts by weight:

| | |
|---|---|
| UNITHOX TM 750 ethoxylated alcohol | 23 |
| SMA TM 2000 styrene-maleic anhydride copolymer | 11.5 |
| ANTARA TM LB-400 | 0.7 |
| 28% aqueous ammonia | 6 |

-continued

| | |
|---|---|
| water (deionized) | 61.7 |

The ingredients were the same as in Example 2.

EXAMPLE 4

This was the same as Example 2, except that SMA™ 1000 was used in place of SMA™ 2000. SMA™ 1000, commercially available from Atochem, Inc., Malvern, Pa., is described by its supplier as a copolymer of styrene and maleic anhydride in a ratio of 1:1, an average molecular weight of about 1600, an Acid Number of about 480, a melting range of about 150°-170° C., and a viscosity of about 29 centipoises at 30° C. in a solution containing 20% by weight total non-volatile material in aqueous ammonia.

EXAMPLE 5

This was the same as Example 2, except that monoethanolamine was used instead of the ammonia used in Example 2.

EXAMPLE 6

This was the same as Example 2, except that the amount of UNITHOX™ 750 used was only 15 parts by weight and the amount of SMA™ 2000 used was increased to 30 parts by weight.

EXAMPLE 7

The concentrate for this example was made using the following ingredients and amounts, with amounts shown in parts by weight:

| | |
|---|---|
| UNITHOX TM 750 ethoxylated alcohol | 18.2 |
| SMA TM 2000 styrene-maleic anhydride copolymer | 9.1 |
| ANTARA TM LB-400 | 0.6 |
| Diethyl ethanol amine | 7.6 |
| water (deionized) | 64.5 |

EXAMPLE 8

The concentrate for this example was made using the following ingredients and amounts, with amounts shown in parts by weight:

| | |
|---|---|
| UNITHOX TM 750 ethoxylated alcohol | 23.0 |
| SMA TM 2000 styrene-maleic anhydride copolymer | 11.5 |
| ANTARA TM LB-400 | 0.8 |
| Sodium hydroxide (50% aqueous) | 6.6 |
| water (deionized) | 59.1 |

The concentrates with the ingredients noted above were made by dispersing the styrene-maleic anhydride copolymer in part of the water, heating the dispersion to about 80° C., adding ammonia, amine, or other base if used slowly with stirring until the polymer dissolved, and then adding the other ingredients (the ethoxylated alcohol having been previously melted at about 115° C.) with continued stirring until a visually homogeneous mixture was produced.

For use in actual lubrication, the concentrates described above were diluted with additional deionized water to produce a composition with 10% by weight total solids. This composition was then applied in an amount sufficient to give an add-on areal density of the amount shown in Table 1, after drying in ambient air without applied heating, to surfaces of steel sheets that were about 457 mm long and had a rectangular cross section about 51 mm wide and 1.5 mm thick. The lubricated surfaces had been previously provided with a zinc phosphate conversion coating having an areal density as shown in Table 1.

The lubricated steel sheets were clamped near the center of one end between a square tungsten carbide die measuring about 13 mm on each side and a much larger tool steel backup die, using a clamping force of about 1820 kilograms. This was sufficient clamping force to thin the sheet slightly from its original thickness. The force required for pulling the sheet at a rate of 30.5 centimeters per minute between the two dies was then measured at both room temperature (about 21° C.) and at about 149° C. (on different but similarly treated sheets).

The drawing forces required for the examples described above and for some comparative examples are shown in Table 1. (The precision of the measurements of the drawing force shown in Table 1 is only about ±10 kg.) Comparison Example 1 used UNITHOX™ 750 only as the lubricant. Comparison Example 2 used only SMA™ 1440 styrenemaleic anhydride copolymer as the lubricant; this is similar to SMA™ 1000 as already described above, but has been partially esterified. Comparison Example 3 used a commercially available sodium stearate containing product (BONDERLUBE™ 234, from Parker+Amchem Div. of Henkel Corporation, Madison Heights, Mich.) that is believed to react to give zinc stearate as the major effective lubricant. Except for the change in lubricant, all the comparison examples were performed in the same way as the examples according to the invention.

TABLE 1

COATING WEIGHTS AND DRAWING FORCES FOR EXAMPLES AND COMPARISON EXAMPLES

| Example or Comparison Example Number | Coating Weights, g/m² | | Drawing Force Required | |
|---|---|---|---|---|
| | Phosphate Precoat | Lubricant Overcoat | At 25° C. | at 149° C. |
| 1 | 15 | 1.0 | 386 | 93 |
| 2 | 15 | 1.0 | 320 | 134 |
| 2 | 25 | 6.3 | 282 | 123 |
| 3 | 15 | 1.0 | 304 | 195 |
| 4 | 15 | 1.0 | 295 | 188 |
| 5 | 15 | 1.0 | 322 | 239 |
| 6 | 15 | 1.0 | 311 | 254 |
| 7 | 13 | 4.1 | 180 | 82 |
| 7 | 22 | 5.2 | 200 | 125 |
| 8 | 12 | 2.0 | 241 | 102 |
| 8 | 23 | 3.1 | 250 | 147 |
| Comp. 1 | 15 | 1.0 | 190 | >900 |
| Comp. 2 | 15 | 1.0 | >900 | 617 |
| Comp. 3 | 15 | 1.0 | 308 | 98 |
| Comp. 3 | 24 | 7.2 | 282 | scored |
| Comp. 3 | 23 | 14.9 | 182 | 66 |

What is claimed is:

1. A liquid composition of matter consisting essentially of:

(A) copolymers of styrene with a maleic compound selected from the group consisting of (i) maleic anhydride, (ii) maleic acid, (iii) salts of maleic acid with ammonia, alkali metal hydroxides, and amines, and (iv) mixtures of any two or more of said (i), (ii), and (iii), said copolymers containing a sufficient number of salt groups to be soluble or dispersible in water; and (B) a component consisting of ethoxylated alcohol molecules having a chemical structure that is produced by condensing ethylene oxide with primary straight chain aliphatic precursor alcohols that have only one hydroxyl group and from 30 to about 65 carbon atoms per molecule, wherein the ratio by weight of component (A) to component (B) is in the range from about 6:1 to about 1:6; and, optionally, (C) water; and, optionally, (D) an extreme pressure resistant and corrosion resistant additive component; and, optionally, (E) a component selected from solid and liquid hydrocarbons.

2. A composition according to claim 1, wherein component (B) is selected from ethoxylated alcohols having from about 20 to about 80 percent of their total weight in the portion of each molecule having the chemical structure $—(CH_2—CH_2—O)_n$, where n is a positive integer.

3. A composition according to claim 2, wherein component (A) is selected from copolymers that have a molar ratio of styrene to maleic compound in the range from about 1:1 to about 3:1.

4. A composition according to claim 3, wherein at least 78 mole percent of the cations associated with the salt groups of the copolymers in component (A) are ammonium cations formed by adding a proton to amine molecules that are capable of forming at least 0.01 M solutions, with a pH value of at least 10, in water.

5. A composition according to claim 4, wherein (a) component (D) is selected from the group consisting of partial esters and salts of partial esters of phosphoric acid with alcohols having a molecular structure that contains both (i) a part having the structure $—(CH_2)_m—$, where m is an integer between about 16 and about 22 inclusive and (ii) a part having the structure $—(CH_2—CH_2—O)_p$, where p is an integer having a sufficiently large value that the total alcohol is soluble in water to the extent of at least about 1.3 percent by weight; and (b) component (D) is present in a weight ratio to the total of components (A) and (B) within the range from about 1:40 to about 1:55.

6. A composition according to claim 3, wherein (a) component (D) is selected from the group consisting of partial esters and salts of partial esters of phosphoric acid with alcohols having a molecular structure that contains both (i) a part having the structure $—(CH_2)_m—$, where m is an integer between about 12 and about 22 inclusive and (ii) a part having the structure $—(CH_2—CH_2—O)_p$, where p is an integer having a sufficiently large value that the total alcohol is soluble in water to the extent of at least about 0.9 percent by weight; and (b) component (D) is present in a weight ratio to the total of components (A) and (B) within the range from about 1:25 to about 1:70.

7. A composition according to claim 2, wherein (a) component (D) is selected from the group consisting of partial esters and salts of partial esters of phosphoric acid with alcohols having a molecular structure that contains both (i) a part having the structure $—(CH_2)_m—$, where m is an integer between about 12 and about 22 inclusive and (ii) a part having the structure $—(CH_2—CH_2—O)_p$, where p is an integer having a sufficiently large value that the total alcohol is soluble in water to the extent of at least about 0.4 percent by weight; and (b) component (D) is present in a weight ratio to the total of components (A) and (B) within the range from 1:10 to 1:200.

8. A composition according to claim 1, wherein (a) component (D) is selected from the group consisting of partial esters and salts of partial esters of phosphoric acid with alcohols having a molecular structure that contains both (i) a part having the structure $—(CH_2)_m—$, where m is an integer between 12 and 22 inclusive and (ii) a part having the structure $—(CH_2—CH_2—O)_p$, where p is an integer having a sufficiently large value that the total alcohol is soluble in water to the extent of at least about 0.1 percent by weight; and (b) component (D) is present in a weight ratio to the total of components (A) and (B) within the range from about 1:10 to about 1:200.

9. A process for cold working a metal substrate, wherein the improvement comprises the presence during the cold working on the surfaces of the metal substrate being cold worked of a lubricating composition consisting essentially of:

(A) copolymers of styrene with a maleic compound selected from the group consisting of (i) maleic anhydride, (ii) maleic acid, (iii) salts of maleic acid with ammonia, alkali metal hydroxides, and amines, and (iv) mixtures of any two or more of said (i), (ii), and (iii), said copolymers containing a sufficient number of salt groups to be soluble or dispersible in water; and (B) a component consisting of ethoxylated alcohol molecules having a chemical structure that is produced by condensing ethylene oxide with primary aliphatic precursor alcohols that have only one hydroxyl group and from 30 to about 65 carbon atoms per molecule, wherein the ratio by weight of component (A) to component (B) is in the range from about 6:1 to about 1:6; and, optionally, (C) water; and, optionally, (D) an extreme pressure resistant and corrosion resistant additive component; and, optionally, (E) a component selected from solid and liquid hydrocarbons.

10. A process according to claim 9, wherein component (B) is selected from ethoxylated alcohols having from about 20 to about 80 percent of their total weight in the portion of each molecule having the chemical structure $—(CH_2—CH_2—O)_n$, where n is a positive integer.

11. A process according to claim 10, wherein component (A) is selected from copolymers that have a molar ratio of styrene to maleic compound in the range about from 1:1 to about 3:1.

12. A process according to claim 11, wherein the equilibrium overpressure of $NH_3$ equivalents as measured by a Drager test apparatus in the atmosphere over said lubricating composition at a temperature of 70° is not more than 25 ppm of ammonia equivalent.

13. A process according to claim 12, wherein (a) component (D) is selected from the group consisting of partial esters and salts of partial esters of phosphoric acid with alcohols having a molecular structure that contains both (i) a part having the structure $—(CH_2)_m—$, where m is an integer between about 16 and about 22 inclusive and (ii) a part having the structure $—(CH_2—CH_2—O)_p$, where p is an integer having a sufficiently large value that the total alcohol is soluble in water to the extent of at least 1.3 percent by weight; and (b) component (D) is present in a weight ratio to the total of components (A) and (B) within the range from about 1:40 to about 1:55.

14. A process according to claim 11, wherein (a) component (D) is selected from the group consisting of partial esters and salts of partial esters of phosphoric acid with alcohols having a molecular structure that contains both (i) a part having the structure $—(CH_2)_m—$, where m is an integer between about 12 and about 22 inclusive and (ii) a part having the structure $—(CH_2—CH_2—O)_p$, where p is an integer having a sufficiently large value that the total alcohol is soluble in water to the extent of at least about 0.9 percent by weight; and (b) component (D) is present in a weight ratio to the total of components (A) and (B) within the range from 1:25 to 1:70.

15. A process according to claim 10, wherein (a) component (D) is selected from the group consisting of partial esters and salts of partial esters of phosphoric acid with alcohols having a molecular structure that contains both (i) a part having the structure $—(CH_2)_m—$, where m is an integer between 12 and 22 inclusive and (ii) a part having the structure $—(CH_2—CH_2—O)_p$, where p is an integer having a sufficiently large value that the total alcohol is soluble in water to the extent of at least about 0.4 percent by weight; and (b) component (D) is present in a weight ratio to the total of components (A) and (B) within the range from about 1:10 to about 1:200.

16. A process according to claim 9, wherein (a) component (D) is selected from the group consisting of partial esters and salts of partial esters of phosphoric acid with alcohols having a molecular structure that contains both (i) a part having the structure $—(CH_2)_m—$, where m is an integer between about 12 and about 22 inclusive and (ii) a part having the structure $—(CH_2—CH_2—O)_p$, where p is an integer having a sufficiently large value that the total alcohol is soluble in water to the extent of at least about 0.1 percent by weight; and (b) component (D) is present in a weight ratio to the total of components (A) and (B) within the range from about 1:10 to about 1:200.

17. A process according to claim 16, wherein (a) the surfaces of the metal substrate to be cold worked are provided, before being provided with said lubricating composition, with a zinc phosphate conversion coating with an areal density of from about 1 to about 50 g/m$^2$ and (b) said lubricating composition is put into place on the surfaces of the metal substrate to be cold worked by (i) coating said surfaces with an aqueous liquid composition having a pH in the range from about 6 to about 11 and containing from about 3 to about 20 percent by weight of total dissolved solids, said coating being in an amount to contain an areal density of solids on the surfaces of the metal substrate to be cold worked in the range from about 0.1 to about 15 g/m$^2$ and (ii) drying the aqueous liquid coating in ambient air before cold working.

18. A process according to claim 15, wherein (a) the surfaces of the metal substrate to be cold worked are provided, before being provided with said lubricating composition, with a zinc phosphate conversion coating with an areal density of from about 1 to about 50 g/m$^2$ and (b) said lubricating composition is put into place on the surfaces of the metal substrate to be cold worked by (i) coating said surfaces with an aqueous liquid composition having a pH in the range from about 6 to about 11 and containing from about 5 to about 20 percent by weight of total dissolved solids, said coating being in an amount to contain an areal density of solids on the surfaces of the metal substrate to be cold worked in the range from about 1.0 to about 8 g/m$^2$ and (ii) drying the aqueous liquid coating in ambient air before cold working.

19. A process according to claim 16, wherein (a) the surfaces of the metal substrate to be cold worked are provided, before being provided with said lubricating composition, with a zinc phosphate conversion coating with an areal density of from about 1 to about 20 g/m$^2$ and (b) said lubricating composition is put into place on the surfaces of the metal substrate to be cold worked by (i) coating said surfaces with an aqueous liquid composition having a pH in the range from about 7.5 to about 9 and containing from 8 to 12 percent by weight of total dissolved solids, said coating being in an amount to contain an areal density of solids on the surfaces of the metal substrate to be cold worked in the range from about 2.0 to about 6 g/m$^2$ and (ii) drying the aqueous liquid coating in ambient air before cold working.

20. A process according to claim 13, wherein (a) the surfaces of the metal substrate to be cold worked are provided, before being provided with said lubricating composition, with a zinc phosphate conversion coating with an areal density of from about 2 to about 15 g/m$^2$ and (b) said lubricating composition is put into place on the surfaces of the metal substrate to be cold worked by (i) coating said surfaces with an aqueous liquid composition having a pH in the range from about 7.5 to about 9 and containing from 8 to 12 percent by weight of total dissolved solids, said coating being in an amount to contain an areal density of solids on the surfaces of the metal substrate to be cold worked in the range from about 2.0 to about 6 g/m$^2$ and (ii) drying the aqueous liquid coating in ambient air before cold working.

* * * * *